US005691124A

United States Patent [19]

Kim et al.

[11] Patent Number: 5,691,124

[45] Date of Patent: Nov. 25, 1997

[54] COLOR PHOTOGRAPHIC ELEMENT WITH IMPROVED PUSH PROCESSING

[75] Inventors: Sang Hyung Kim, Pittsford; Spencer Alan Pugh, Penfield, both of N.Y.

[73] Assignee: Eastman Kodak Company, Rochester, N.Y.

[21] Appl. No.: 581,297

[22] Filed: Dec. 28, 1995

Related U.S. Application Data

[60] Provisional application No. 60/003,822, Sep. 15, 1995.

[51] Int. Cl.[6] ..... G03C 1/46

[52] U.S. Cl. ..... 430/505; 430/506; 430/509; 430/543; 430/544; 430/551; 430/567; 430/379

[58] Field of Search ..... 430/505, 506, 430/509, 543, 544, 551, 567, 379

[56] References Cited

U.S. PATENT DOCUMENTS

| | | | |
|---|---|---|---|
| 4,626,498 | 12/1986 | Shuoto et al. | 430/379 |
| 5,298,369 | 3/1994 | Munshi et al. | 430/379 |
| 5,378,591 | 1/1995 | Droin et al. | 430/506 |
| 5,391,469 | 2/1995 | Dickerson | 430/506 |
| 5,460,932 | 10/1995 | Chen et al. | 430/506 |
| 5,545,513 | 8/1996 | Edwards | 430/506 |
| 5,576,158 | 11/1996 | Ford et al. | 430/506 |

FOREIGN PATENT DOCUMENTS

| | | |
|---|---|---|
| 359169 | 3/1990 | European Pat. Off. . |
| 0474166A1 | 9/1991 | European Pat. Off. . |
| 0529737A1 | 8/1992 | European Pat. Off. . |
| 0570923A1 | 5/1993 | European Pat. Off. . |
| 54094032 | 7/1979 | Japan . |
| 7005647 | 1/1995 | Japan . |

*Primary Examiner*—Geraldine Letscher

*Attorney, Agent, or Firm*—Sarah Meeks Roberts; Arthur H. Rosenstein

[57] ABSTRACT

This invention provides color silver halide photographic element comprising a red light-sensitive, cyan dye-forming unit comprising a photosensitive silver halide emulsion layer and an image dye-forming coupler; a green light-sensitive, magenta dye-forming unit comprising a photosensitive silver halide emulsion layer and an image dye-forming coupler; and a blue light-sensitive, yellow dye-forming unit comprising a photosensitive silver halide emulsion layer and an image dye-forming coupler; the photographic element further comprising a first layer and a second layer, the second layer being a layer which provides a site of development for solution physical development; wherein at least one of the dye-forming units comprises two or more emulsion layers spectrally sensitized to the same region of the visible spectrum, but exhibiting different photographic sensitivities and wherein the first layer is positioned adjacent to the layer containing the slowest emulsion of said dye-forming unit and between the layer containing the slowest emulsion and the second layer. Preferably the photographic element is a color reversal photographic element.

27 Claims, No Drawings

COLOR PHOTOGRAPHIC ELEMENT WITH IMPROVED PUSH PROCESSING

CROSS REFERENCE TO RELATED APPLICATION

Reference is made to an priority claimed from U.S. Provisional application Ser. No. 60/003,822, filed 15 Sep. 1995, entitled Color Reversal Photographic Element.

FIELD OF THE INVENTION

This invention relates to a color photographic element having a particular multilayer format which makes it suitable for what is known in the art as "push processing". This invention more specifically relates to color silver halide reversal photographic elements.

BACKGROUND OF THE INVENTION

Push processing is a technique that is used often in the photographic industry to correct for intentional or unintentional underexposures. In essence, photographers who have underexposed a photographic element—for instance, photographers who exposed a slow film at a faster than appropriate speed at an athletic event in order to photograph a participant or object in rapid motion—can compensate for the relatively small amount of silver that was formed in the underexposure, thus recapturing lost speed, by prolonging the development of the film in the black and white first developer. Despite the apparent advantages of such a technique, problems can arise if the development of one of the color records proceeds at a different rate than that of the other color records. In such instances, degradation of color balance occurs.

Many techniques have been offered for overcoming the color balance problems caused by push processing. In U.S. Pat. Nos. 5,478,711 and 5,460,932 the application of development accelerators and certain release compounds capable of providing delayed release of development inhibitor moieties was explored. In U.S. Pat. No. 5,298,369, a photographic element suitable for push processing was described which comprised a colloidal silver containing layer operatively associated with one of the light sensitive layers of a color record. The colloidal silver containing layer conferred a speed increase on the layer in which it was operatively associated, such speed increase being relative to the situation where the layer was not present. The invention was asserted to reduce, or eliminate color mismatches that result from push processing.

Utilization of the photographic elements described in U.S. Pat. No. 5,298,369, however, is not a panacea for the problems caused by push processing. The present inventors found that when an increase in blue speed was desired, and the examples as set forth in this patent were followed—that is, when an interlayer containing colloidal silver was provided adjacent to a target blue sensitive silver halide layer—speed was indeed increased in the target layer. However, speed was increased to an excessive degree thus diminishing color balance in the toe regions of the three color records' characteristic curves.

The present inventors determined that good color balance could only be obtained by modifying the effect of "solution physical development" on the target dye-forming emulsion layer. Solution physical development is a development process which results when certain developers, most notably Process E-6 black and white developers used with color reversal films, are utilized (see The Mechanism of Development in *The Theory of the Photographic Process*, fourth edition, edited by T. H. James, Macmillan Publishing Co., New York). Solution physical development can have a large effect on emulsion speed, especially in the presence of a development accelerator, such as colloidal silver (also known as Carey Lea silver). Therefore, the task of providing a photographic element with good color balance is more complicated for emulsions undergoing such development. The effect of solution physical development is especially pronounced on slower emulsions.

The present inventors sought to provide a means by which speed could be increased during push processing but not to an extent where the toe color balance of a photographic element is deleteriously affected.

SUMMARY OF THE INVENTION

This invention provides a color silver halide photographic element comprising a support having situated thereon a red light-sensitive, cyan dye-forming unit comprising a photosensitive silver halide emulsion layer and an image dye-forming coupler; a green light-sensitive, magenta dye-forming unit comprising a photosensitive silver halide emulsion layer and an image dye-forming coupler; and a blue light-sensitive, yellow dye-forming unit comprising a photosensitive silver halide emulsion layer and an image dye-forming coupler; the photographic element further comprising a first layer and a second layer, the second layer being a layer which provides a site of development for solution physical development; wherein at least one of the dye-forming units comprises two or more emulsion layers spectrally sensitized to the same region of the visible spectrum, but exhibiting different photographic sensitivities and wherein the first layer is positioned adjacent to the layer containing the slowest emulsion of said dye-forming unit and between the layer containing the slowest emulsion and the second layer.

This invention further provides the above photographic element wherein the layer containing the slowest emulsion of said dye-forming unit comprises tabular silver halide grains having a mean equivalent circular diameter of greater than 0.44 microns and less than 0.89 microns. Preferably the above photographic elements are color reversal photographic elements.

It has been found that photographic elements, particularly reversal elements, containing the first and second layers as described above have superior color balance after being subjected to push processing. More surprisingly, it has been found that additional improvements in color balance during push processing can be achieved with a photographic element containing the first and second layer in combination with slow emulsions having a specific range of grain sizes.

DETAILED DESCRIPTION OF THE INVENTION

Many photographic elements contain layers (herein called the second layer) which act as sites for solution physical development. These layers, intentionally or unintentionally, may accelerate the development of nearby silver halide image dye-forming layers. This effect is especially pronounced during push processing. The inventors have discovered that certain interlayers (herein called the first layer) may act to modify such development acceleration and may be utilized in conjunction with the second layer to control color balance in the layers affected by the solution physical development during push processing. This is particularly true when the interlayers are used in combination with a specific range of silver halide grain sizes as later described.

The color silver halide photographic elements of the invention can have any of the image forming or non-imaging forming layers known in the art. The photographic element is a multilayer, multicolor element. Most preferable it is reversal photographic element. The multicolor element contains dye image-forming units sensitive to each of the three primary regions of the visible light spectrum. Each unit may be comprised of a single emulsion layer, or of multiple emulsion layers spectrally sensitive to the same or substantially the same region of the spectrum. The layers of the element, can be arranged in various orders as known in the art.

In this invention the multicolor photographic element comprises, preferably in order from the support, a cyan dye image-forming unit comprising at least one red light-sensitive silver halide emulsion layer having associated therewith at least one cyan dye-forming coupler; a magenta image-forming unit comprising at least one green light-sensitive silver halide emulsion layer having associated therewith at least one magenta dye-forming coupler; and a yellow dye image-forming unit comprising at least one blue light-sensitive silver halide emulsion layer having associated therewith at least one yellow dye-forming coupler. In this invention the dye-forming unit of interest (i.e. the dye-forming unit for which one wants to modify the solution physical development effect caused by the second layer) comprises two or more emulsion layers spectrally sensitized to the same region of the visible spectrum, but exhibiting different photographic sensitivities. By photographic sensitivity, it is meant what is known in the art as photographic speed.

In this invention the first layer is adjacent to the layer containing the slowest emulsion of the dye-forming unit of interest and is between said slowest layer and the second layer which acts as the site for the solution physical development. There may be more than one layer which accelerates solution physical development in a photographic element (second layer) and the interlayer (first layer) of this invention may be utilized for each dye-forming unit which is affected by such a second layer.

As discussed, the dye-forming unit of interest comprises more than one silver halide emulsion layer. In a preferred embodiment the tabular emulsions of the invention as described hereafter are located in the layer with the slowest emulsion of said dye-forming unit. Often a dye-forming unit containing multiple layers contains at least three silver halide emulsions of different photographic sensitivities. These are typically described as the fast emulsion, the mid emulsion and the slow emulsion. These emulsions can be coated separately in different layers or they can be blended and coated in the same layer, or any combination thereof. A two layer dye-forming unit might contain, for example, one layer containing only a fast emulsion and another layer containing both a mid emulsion and a slow emulsion. Other combinations of emulsions are also possible and are within the scope of this invention. Dye-forming units can also contain more than three silver halide emulsions. Regardless of the details of the composition of the layers, the layer with the slowest emulsion is adjacent to the first layer.

In one embodiment of the invention the dye-forming unit of interest comprising two or more emulsion layers is the blue light-sensitive, yellow dye-forming unit; and the first and second layers are positioned between the blue light-sensitive, yellow dye-forming unit and the green light-sensitive, magenta dye-forming unit. In another embodiment the hereafter described tabular emulsions are contained in the layer containing the slowest emulsion of the blue light-sensitive layers.

The first layer can be any hydrophilic colloidal layer known in the art. It may therefore comprise gelatin (e.g. ossein) or gelatin derivatives. Other specific suitable hydrophilic colloid materials which can be used alone or in combination include cellulose derivatives, polysaccharides such as dextran, gum arabic and the like; synthetic polymeric substances such as water soluble polyvinyl compounds like poly(vinylpyrrolidone), acrylamide polymers and the like. Other materials are described in U.S. Pat. No. 5,298,369 and *Research Disclosure* December 1989 Item 308119, par. IXA, which are incorporated herein by reference.

The first layer must modify the effect of the accelerated development of the dye-forming unit of interest caused by the solution physical development. The first layer typically is coated at levels between 260 and 2200 mg gelatin/$m^2$; and preferably at levels between 500 and 1000 mg gelatin/$m^2$. The first layer may contain additional additives such as thickening agents, surfactants, hardeners, couplers, oxidized developing agent scavengers, development inhibitors, development accelerators, absorbing dyes, and the like. These compounds may be added in amounts and by methods known in the art. The first layer typically will not contain colloidal silver.

The first layer preferably comprises an oxidized developing agent scavenger. Exemplary scavengers include disulfoamidophenols and the ballasted or otherwise non-diffusing antioxidants illustrated in U.S. Pat. Nos. 2,336,327; 2,728,659; and 2,403,721, all of which are incorporated herein by reference. Others are described in *Research Disclosure* December 1989 Item 308119, par. VII.I, and *Research Disclosure*, September 1994, Item 36544, par X.D which are incorporated herein by reference. It is preferred that the scavenger be incorporated into the layer in an amount from 10–1,000 mg/$m^2$; preferably an amount from 50–200 mg/$m^2$; and optimally an amount from 75–125 mg/$m^2$.

The second layer is any layer which acts as a site for solution physical development (see The Mechanism of Development in *The Theory of the Photographic Process*, fourth edition, edited by T. H. James, Macmillan Publishing Co., New York) incorporated herein by reference. The second layer can also be selected from those layers known in the art. Examples of such layers include, but are not limited to, layers comprised of fogged silver halide grains or colloidal silver layers. In a colloidal silver layer the colloidal silver may be any colloidal elemental silver of the types commonly employed in the photographic arts. For example, it may be yellow colloidal silver, i.e., Carey Lea silver, or black or gray/black colloidal silver. In general, such silver colloids contain silver particles having a size within the range from about 50 to about 100 angstroms. The silver colloids are generally formed in gelatin or other hydrophilic colloids of the type described above. For example, Carey Lea silver is generally prepared by a process comprising silver reduction in a basic solution obtained by reacting dextrin and silver nitrate. In many instances, phthlated gelatin is added to facilitate washing of the silver product.

The level of colloidal silver may differ depending on the purpose of the layer. Typically the level of colloidal silver will be in the range of from 5 to 500 mg/$m^2$. More typically, it will be in the range of from 25 to 250 mg/$m^2$, and usually, it will be in the range of from 50 to 150 mg/$m^2$.

Often a colloidal silver layer is utilized as a yellow filter layer and appropriate levels of silver will be utilized for that purpose. Alternatively, a layer containing yellow filter dye may be used. Suitable dyes include those described in U.S.

Pat. Nos. 2,538,008; 2,538,009; 4,420,555; 4,950,586; 4,948,718; 4,948,717; 4,940,654; 4,923,788; 4,900,653; 4,861,700; 4,857,446; 4,855,221, 5,213,956, 5,213,957 and 5,298,377; U.K. Patents 695,873 and 760,739; European Patent Application 430,186; and Provisional Application Ser. No. 60/001,801 entitled "Photographic Element Comprising A Novel Filter Dye" filed Jul. 27, 1995. In that case the second layer may comprise fogged grains instead of colloidal silver. The yellow filter dye may be in the second layer or in a separate layer. A yellow filter dye may also be included in the colloidal silver layer.

Other additives may be added to the second layer. They can be any of the additives described above for addition to the first layer. The compounds may be added in amounts and by methods known in the art.

The element may contain layers in addition to those described above. Such layers include filter layers, interlayers, overcoat layers, subbing layers, and the like. The photographic elements may also contain a transparent magnetic recording layer such as a layer containing magnetic particles on the underside of a transparent support, as described in *Research Disclosure,* November 1992, Item 34390 published by Kenneth Mason Publications, Ltd., Dudley Annex, 12a North Street, Emsworth, Hampshire PO10 7DQ, ENGLAND. Typically, the element will have a total thickness (excluding the support) of from about 5 to about 30 microns. Further, the photographic elements may have an annealed polyethylene naphthalate film base such as described in Hatsumei Kyoukai Koukai Gihou No. 94-6023, published Mar. 15, 1994(Patent Office of Japan and Library of Congress of Japan) and may be utilized in a small format system, such as described in *Research Disclosure,* June 1994, Item 36230 published by Kenneth Mason Publications, Ltd., Dudley Annex, 12a North Street, Emsworth, Hampshire PO10 7DQ, ENGLAND, and such as the Advanced Photo System, particularly the Kodak ADVANTIX films or cameras.

In the more preferred photographic elements of this invention the layer containing the slowest emulsion of the dye-forming unit of interest comprises tabular silver halide grains meeting specific parameters. The slowest emulsion in said layer will comprise silver halide grains with a mean equivalent circular diameter greater than 0.44 microns and less than 0.89 microns, more preferably greater than 0.47 microns and less than 0.80 microns and most preferably greater than 0.50 microns and less than 0.70 microns. If there is only one emulsion in the layer that emulsion is the slowest emulsion as defined above preferably, such tabular grains have a mean Tabularity (Tabularity being defined as a grain's equivalent circular diameter in microns divided by the square of its thickness) greater than 10, and more preferably greater than about 25.

When silver halide grains of only one emulsion type are in the silver halide emulsion layer containing the slowest emulsion it is contemplated that the preferred tabular grains have the specified mean equivalent circular diameter and account for at least about 50% of the projected area of grains in the particular emulsion layer. More preferably, they account for at least 75% of the projected area; and optimally, they account for at least 90% of the projected area. If the preferred tabular emulsion is combined or blended with an emulsion of another speed to form, for example, a slow-mid layer, the preferred tabular grains donated by the slowest emulsion may account for about 25% to 75% of the projected area of grains in the particular emulsion layer, more preferably closer to 50%. The preferred tabular grains donated by the slowest emulsion should account for at least 25%, and preferably at least 40%, of the projected area of grains in the particular emulsion layer when the layer contains a blended emulsion.

The emulsions used in any layer can be either monodisperse or polydisperse as precipitated. The grain size distribution of the emulsion can be controlled by silver halide grain separation techniques or by blending silver halide emulsions of differing grain sizes.

The grains utilized in the silver halide photographic elements may be comprised of silver chloride, silver bromide, silver bromochloride, silver chlorobromide, silver iodochloride, silver iodobromide, silver bromoiodochloride, silver chloroiodobromide, silver iodobromochloride, and silver iodochlorobromide emulsions. In accordance with the invention, it is preferred that the grains in each of the dye-forming units contain at least 75% and more preferably at least 90% silver bromoiodide. Optimally they are entirely silver bromoiodide. The iodide content in such emulsions is preferably from 1 to 15 mole percent, preferably 2 to 6 mole percent, and optimally 2 to 4 mole percent.

The silver halide emulsions employed in the other dye-forming layers and/or units of the invention can contain grains of any size and morphology. The grains may take the form of cubes, octahedrons, cubo-octahedrons, or any of the other naturally occurring morphologies of cubic lattice type silver halide grains. Further, the grains may be irregular such as spherical grains or tabular grains. Particularly preferred are grains having a tabular morphology, and more preferred are those having a mean Tabularity greater than 10, and more preferably a mean Tabularity greater than about 25.

The silver halide grains can be contained in any conventional dispersing medium capable of being used in photographic emulsions. Specifically, it is contemplated that the dispersing medium be an aqueous gelatino-peptizer dispersing medium, of which gelatin—e.g., alkali treated gelatin (cattle bone and hide gelatin)—or acid treated gelatin (pigskin gelatin) and gelatin derivatives—e.g., acetylated gelatin, phthalated gelatin—are specifically contemplated. When used, gelatin is preferably at levels of 0.01 to 100 grams per total silver mole. Also contemplated are dispersing mediums comprised of synthetic colloids.

Silver halide color reversal films are typically associated with an indication for processing by a color reversal process. Reference to a film being associated with an indication for processing by a color reversal process most typically means the film, its container, or packaging (which includes printed inserts provided with the film), will have an indication on it that the film should be processed by a color reversal process. The indication may, for example, be simply a printed statement stating that the film is a "reversal film" or that it should be processed by a color reversal process, or simply a reference to a known color reversal process such as "Process E-6". A "color reversal" process in this context is one employing treatment with a non-chromogenic developer (that is, a developer which will not imagewise produce color by reaction with other compounds in the film; sometimes referenced as a "black and white developer"). This is followed by fogging unexposed silver halide, usually either chemically or by exposure to light. Then the element is treated with a color developer (that is, a developer which will produce color in an imagewise manner upon reaction with other compounds in the film).

In a typical construction, a reversal film does not have any masking couplers. Furthermore, reversal films have a gamma generally between 1.5 and 2.0, a gamma which is much higher than the gamma for typical negative materials.

In the following Table, reference will be made to (1)*Research Disclosure,* December 1978, Item 17643, (2)*Research Disclosure,* December 1989, Item 308119, (3)*Research Disclosure,* September 1994, item 36544, all published by Kenneth Mason Publications Ltd., Dudley Annex, 12a North Street, Emsworth, Hampshire PO10 7DQ, ENGLAND, the disclosures of which are incorporated herein by reference. The Table and the references cited in the Table are to be read as describing particular components suitable for use in the photographic element of the invention. The Table and its cited references also describe suitable ways of exposing, processing and manipulating the elements, and the images contained therein. Components which are particularly suitable for use in the photographic element of the invention are described in *Research Disclosure,* February 1995, Item 37038, published by Kenneth Mason Publications, Ltd., Dudley Annex, 12a North Street, Emsworth, Hampshire PO10 7DQ, ENGLAND, the disclosure of which is incorporated herein by reference.

| Reference | Section | Generic System Element(s) |
|---|---|---|
| 1 | I, II | Grain composition, |
| 2 | I, II, IX, X, XI, XII, XIV, XV | morphology and preparation; Emulsion preparation including hardeners, coating |
| 3 | I, II, III, IX A & B | aids, addenda, etc. |
| 1 | III, IV | Chemical sensitization and |
| 2 | III, IV | spectral sensitization/ |
| 3 | IV, V | desensitization |
| 1 | V | UV dyes, optical brighteners, |
| 2 | V | luminescent dyes |
| 3 | VI | |
| 1 | VI | Antifoggants and stabilizers |
| 2 | VI | |
| 3 | VII | |
| 1 | VIII | Absorbing and scattering |
| 2 | VIII, XIII, XVI | materials; Antistatic layers; matting agent |
| 3 | VII, IX C & D | |
| 1 | VII | Image-couplers and image- |
| 2 | VII | modifying couplers; Dye |
| 3 | X | stabilizers and hue modifiers |
| 1 | XVII | Supports |
| 2 | XVII | |
| 3 | XV | |
| 3 | XI | Specific layer arrangements |
| 3 | XII, XIII | Negative working emulsions; Direct positive emulsions |
| 2 | XVIII | Exposure |
| 3 | XVI | |
| 1 | XIX, XX | Chemical processing; |
| 2 | XIX, XX, XXII | Developing agents |
| 3 | XVIII, XIX, XX | |
| 3 | XIV | Scanning and digital processing procedures |

Supports for photographic elements of the present invention include polymeric films such as cellulose esters (for example, cellulose triacetate and diacetate) and polyesters of dibasic aromatic carboxylic acids with divalent alcohols (for example, poly(ethylene-terephthalate), poly(ethylene-napthalates)), paper and polymer coated paper. Such supports are described in further detail in *Research Disclosure* 3, Section XV.

The photographic elements may also contain additional materials that accelerate or otherwise modify the processing steps of bleaching or fixing to improve the quality of the image. Bleach accelerators described in European Patent Applications 193,389 and 301,477; U.S. Pat. Nos. 4,163,669; 4,865,956; and 4,923,784 are particularly useful. Also contemplated is the use of nucleating agents, development accelerators or their precursors (UK Patents 2,097,140 and 2,131,188); electron transfer agents (U.S. Pat. Nos. 4,859,578 and 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes, either as oil-in-water dispersions, latex dispersions or as solid particle dispersions. Additionally, they may be used with "smearing" couplers (e.g., as described in U.S. Pat. Nos. 4,366,237; 4,420,556; 4,543,323 and European Patent Application 96,570.) Also, the couplers may be blocked or coated in protected form as described, for example, in Japanese Application 61/258,249 or U.S. Pat. No. 5,019,492.

The photographic elements may further contain other image-modifying compounds such as "Developer Inhibitor-Releasing" compounds (DIR's). DIR compounds are disclosed, for example, in "Developer-Inhibitor-Releasing (DIR) Couplers for Color Photography," C. R. Barr, J. R. Thirtle and P. W. Vittum in *Photographic Science and Engineering,* Vol. 13, p. 174 (1969), incorporated herein by reference. DIRs that have particular application in color reversal elements are disclosed in U.S. Pat. Nos. 5,399,465; 5,380,633; 5,399,466; and 5,310,642.

It is also contemplated that the concepts of the present invention may be employed to obtain reflection color prints. The emulsions and materials to form elements of the present invention, may be coated on a pH adjusted support as described in U.S. Pat. No. 4,917,994; with epoxy solvents (European Patent Application 0 164 961); with additional stabilizers (as described, for example, in U.S. Pat. Nos. 4,346,165; 4,540,653; and 4,906,559); with ballasted chelating agents such as those in U.S. Pat. No. 4,994,359 to reduce sensitivity to polyvalent cations such as calcium; and with stain reducing compounds such as described in U.S. Pat. Nos. 5,068,171 and 5,096,805. Other compounds useful in the elements of the invention are disclosed in Japanese Published Applications 83-09,959; 83-62,586; 90-072,629; 90-072,630; 90-072,632; 90-072,633; 90-072,634; 90-077,822; 90-078,229; 90-078,230; 90-079,336; 90-079,338; 90-079,690; 90-079,691; 90-080,487; 90-080,489; 90-080,490; 90-080,491; 90-080,492; 90-080,494; 90-085,928; 90-086,669; 90-086,670; 90-087,361; 90-087,362; 90-087,363; 90-087,364; 90-088,096; 90-088,097; 90-093,662; 90-093,663; 90-093,664; 90-093,665; 90-093,666; 90-093,668; 90-094,055; 90-094,056; 90-101,937; 90-103,409; 90-151,577.

The silver halide grains to be used in the invention may be prepared according to methods known in the art, such as those described in *Research Disclosure* 3 and James, *The Theory of the Photographic Process.* These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc., at suitable values during formation of the silver halide by precipitation.

The silver halide to be used in the invention may be advantageously subjected to chemical sensitization with noble metal (for example, gold) sensitizers, middle chalcogen (for example, sulfur) sensitizers, reduction sensitizers and others known in the art. Compounds and techniques useful for chemical sensitization of silver halide are known in the art and described in *Research Disclosure* 3 and the references cited therein.

The emulsion can also include any of the addenda known to be useful in photographic emulsions. These include chemical sensitizers, such as active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 5 to 8, and temperatures of from 30° to 80° C., as illustrated in *Research Disclosure*, June 1975, item 13452 and U.S. Pat. No. 3,772,031.

The silver halide may be sensitized by sensitizing dyes by any method known in the art, such as described in *Research Disclosure* 3. Examples of dyes include dyes from a variety of classes, including the polymethine dye class, which includes the cyanines, merocyanines, complex cyanines and merocyanines (i.e., tri-tetra-, and polynuclear cyanines and merocyanines), oxonols, hemioxonols, styryls, merostyryls, and streptocyanines. The dye may be added to an emulsion of the silver halide grains and a hydrophilic colloid at any time prior to (e.g., during or after chemical sensitization) or simultaneous with the coating of the emulsion on a photographic element. The dye/silver halide emulsion may be mixed with a dispersion of color image-forming coupler immediately before coating or in advance of coating.

Photographic elements of the present invention can be imagewise exposed using any of the known techniques, including those described in *Research Disclosure* 3. This typically involves exposure to light in the visible region of the spectrum, and typically such exposure is of a live image through a lens. However, the photographic elements of the present invention may be exposed in a film writer as described above. Exposure in a film writer is an exposure to a stored image (such as a computer stored image) by means of light emitting devices (such as light controlled by light valves, CRT and the like).

The photographic elements of this invention are most suitable for use with processing systems which depend in part on solution physical development, or in which such development may unintentionally take place. The Process E-6 black-and-white developer is notable in this aspect, having a high level of silver ion chelating agents, known colloquially as silver halide solvents. Preferably the photographic elements comprising the composition of the invention are color reversal elements. These may be processed in any color reversal process. Such processes, as described above, require first treating the element with a black and white developer, followed by fogging non-exposed grains using chemical or light fogging, followed by treatment with a color developer.

Preferred non-chromogenic developers (that is, black and white developers) are hydroquinones (such as hydroquinone sulphonate).

Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl-N-ethyl-N-(b-(methanesulfonamido) ethylaniline sesquisulfate hydrate, 4-amino-3-methyl-N-ethyl-N-(b-hydroxyethyl)aniline sulfate, 4-amino-3-b-(methanesulfonamido)ethyl-N,N-diethylaniline hydrochloride and 4-amino-N-ethyl-N-(2-methoxyethyl)-m-toluidine di-p-toluene sulfonic acid.

Development is followed by bleach-fixing, to remove silver or silver halide, washing and drying. Bleaching and fixing can be performed with any of the materials known to be used for that purpose. Bleach baths generally comprise an aqueous solution of an oxidizing agent such as water soluble salts and complexes of iron (III)(e.g., potassium ferricyanide, ferric chloride, ammonium or potassium salts of ferric ethylenediaminetetraacetic acid), water-soluble persulfates (e.g., potassium, sodium, or ammonium persulfate), water-soluble dichromates (e.g., potassium, sodium, and lithium dichromate), and the like. Fixing baths generally comprise an aqueous solution of compounds that form soluble salts with silver ions, such as sodium thiosulfate, ammonium thiosulfate, potassium thiocyanate, sodium thiocyanate, thiourea, and the like. Further details of bleach and fixing baths can be found in *Research Disclosure* 3.

The photographic elements can be incorporated into exposure structures intended for repeated use or exposure structures intended for limited use, variously referred to as single use cameras, lens with film, or photosensitive material package units. The color reversal elements of the present invention can also be used by exposing them in an electronic film writer (such film writers typically expose the film by laser, laser diode, or some other controlled light source).

The practice of the invention is described in detail below with reference to specific illustrative examples, but the invention is not to be construed as being limited thereto.

EXAMPLES

Example 1

The importance of the first layer in providing the advantages of the invention—that is, in correcting the imbalance brought on by the presence of a colloidal silver containing second layer—is demonstrated in the following example. In this example a multicolor reversal element having a colloidal silver containing second layer between a blue-sensitive record and a green-sensitive record was prepared by conventional means. A first layer containing an oxidized developing agent scavenger was inserted between the blue-sensitive record and the colloidal silver containing layer in the inventive examples. Toe speed was measured as relative log exposure units (×100) required to achieve a density of 0.3. ΔSpeed represented the increase in Toe Speed relative to normal development time when 11 minute push processing was performed.

TABLE 1

| | | | Toe Speed | | |
|---|---|---|---|---|---|
| Sample | Description | Color Record | Conventional Development (6 minutes) | Pushed Development (11 minutes) | ΔSpeed |
| 1 | comparison | R | 27 | 87 | 60 |
| | | G | 33 | 92 | 59 |
| | | B | 42 | 115 | 73 |
| 2 | invention | R | 25 | 85 | 60 |
| | | G | 31 | 90 | 59 |
| | | B | 39 | 101 | 62 |

As can be seen from Table 1, the presence of the interlayer (the first layer of the invention) between the colloidal silver containing layer and the blue-sensitive record (Sample 2) provides for a much lower speed increase during push processing than if the layer were not present. The result is that color balance during push processing is optimized.

Example 2

In the next example, the advantages provided by having the first layer of the invention between a colloidal silver containing layer (the second layer of the invention) and a blue-sensitive, yellow dye-forming layer having tabular grains with a mean equivalent circular diameter greater than 0.44 and less than 0.89 microns is explored. The samples were prepared by conventional methods. A series of multilayer color reversal photographic elements of the following layer structure was prepared:

Support
Layer 1: Antihalation Layer
Layer 2: First Interlayer
Layer 3: First Red-Sensitive Layer (slow)
Layer 4: Second Red-Sensitive Layer (mid)
Layer 5: Third Red-Sensitive Layer (fast)
Layer 6: Second Interlayer
Layer 7: Third Interlayer
Layer 8: First Green-Sensitive Layer (slow)
Layer 9: Second Green-Sensitive Layer (mid)
Layer 10: Third Green-Sensitive Layer (fast)
Layer 11: Fourth Interlayer
Layer 12: Fifth Interlayer
Layer 13: Sixth Interlayer
Layer 14: First Blue-Sensitive Layer (slow)
Layer 15: Second Blue-Sensitive Layer (fast)
Layer 16: First Overcoat Layer.
Layer 17: Second Overcoat Layer.

Each of the layers was prepared by conventional methods and contained conventional couplers. The 12th layer represented the second layer of the invention, that is it contained colloidal silver in an amount equal to 75 mg/m$^2$. It also contained 680 mg/m$^2$ gelatin, a surfactant, a polymeric thickening agent, and a hardener. Layer 13 represented the invention's first layer. It contained gelatin at a level of 650 mg/m$^2$ gelatin, a thickening agent (copolymer of: acrylamide(20%) and 2-acrylamide-2-methyl propane sulphonic acid (80%)), and an oxidized developing agent scavenger of the structure:

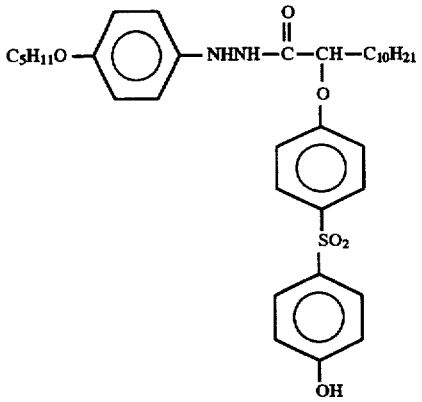

Layer 14, the slow blue light-sensitive emulsion layer of the blue light-sensitive, yellow dye-forming unit contained a catechol sequestering agent, antifoggant, a yellow dye-forming coupler and a release compound capable of providing delayed release of a development inhibitor moiety. The silver bromoiodide grains of the slowest emulsion (ranging from three to four mole percent iodide) in this emulsion layer were formed by precipitation in the presence of potassium iridium hexachloride. The grains were tabular grains having a mean equivalent circular diameter as described in Tables 2 and 3 which follow. All of the slowest emulsions of the slow blue light-sensitive emulsion layer had a mean Tabularity greater than 30. The slowest emulsion in this layer accounted for 46% of the projected area of the grains in the emulsion layer. The grains were chemically and spectrally sensitized by methods known in the art. Layer 14 was a blended layer also containing a mid-yellow emulsion of 3% iodide tabular silver bromoiodide grains. The grains were 1.0 microns×0.13 microns with a tabularity of 59. It is contemplated that a mid-yellow emulsion having a mean ECD greater than 0.85 microns and less than 1.5 microns would be suitable in this embodiment. It is further contemplated that iodide levels of 2 to 6% would be suitable in this embodiment.

Layer 15 contained a fast-yellow emulsion of 2% iodide tabular silver bromoiodide grains. The grains were 2.0 microns×0.15 microns with a mean tabularity of 89. It is contemplated that a fast-yellow emulsion having a mean ECD greater than 1.5 microns and less than 2.5 microns would be suitable in this embodiment. It is further contemplated that iodide levels of 2 to 6% would be suitable in this embodiment.

The elements were given a stepped exposure on a Type 1-b sensitometer having 5500K color temperature with a Wratten™ (Eastman Kodak Company) 2B filter for 1/50 second. The exposed elements were then processed using the known E-6 processing scheme.

In the tables below, all speeds were slow blue speeds (×100), determined at a density of 0.3 as in Example 1. Speed1 represents the speed obtained after conventional development for 6 minutes. ΔSpeed represents the increase in speed from Speed1 that resulted from push processing (development for 11 minutes). ECD represents the mean equivalent circular diameter of the grains contained in the slowest emulsion of the slow blue-sensitive emulsion layer (layer 14). T represents the mean tabularity of the grains in the slowest emulsion of the slow blue-sensitive emulsion layer. KI represented the percent iodide content of the grains in the slowest emulsion of the slow blue-sensitive emulsion layer. Iodide concentration was determined not to have a bearing on the advantages provided by the invention.

In order to provide neutral color balance with the magenta and cyan dye-forming units of the element and to maintain that color balance after push processing, it was desired that both conventional speed (Speed1) and the improvement in speed as a result of push processing (ΔSpeed) be 60±5 units. As can be seen from the data, only the inventive samples provide these results.

TABLE 2

| Samples | KI | ECD | T | Speed1 | ΔSpeed | |
|---|---|---|---|---|---|---|
| 3 | 4 | 0.30 | 56 | 78 | 49 | comparison |
| 4 | 4 | 0.35 | 71 | 71 | 56 | comparison |
| 5 | 4 | 0.44 | 62 | 68 | 57 | comparison |
| 6 | 4 | 0.67 | 83 | 61 | 61 | invention |
| 7 | 4 | 0.73 | 55 | 57 | 62 | invention |

TABLE 3

| Samples | KI | ECD | T | Speed1 | ΔSpeed | |
|---|---|---|---|---|---|---|
| 8 | 3 | 0.51 | 32 | 61 | 64 | invention |
| 9 | 3 | 0.51 | 32 | 60 | 63 | invention |
| 10 | 3 | 0.58 | 45 | 64 | 59 | invention |
| 11 | 3 | 0.78 | 50 | 61 | 61 | invention |
| 12 | 3 | 0.89 | 57 | 58 | 67 | comparison |
| 13 | 3 | 0.97 | 61 | 58 | 67 | comparison |

The invention has been described in detail with particular reference to certain preferred embodiments thereof, but it will be understood that variations and modifications can be effected within the spirit and scope of the invention.

What is claimed is:

1. A color silver halide photographic element comprising a support having situated thereon a red light-sensitive, cyan dye-forming unit comprising a photosensitive silver halide emulsion layer and an image dye-forming coupler; a green light-sensitive, magenta dye-forming unit comprising a photosensitive silver halide emulsion layer and an image dye-forming coupler; and a blue light-sensitive, yellow dye-forming unit comprising a photosensitive silver halide emulsion layer and an image dye-forming coupler; the photographic element further comprising a first layer and a second layer, the first layer containing between 260 and 2200 mg of gelatin/$m^2$ and the second layer being a layer which provides a site of development for solution physical development; wherein at least one of the dye-forming units comprises two or more emulsion layers spectrally sensitized to the same region of the visible spectrum, but exhibiting different photographic sensitivities and wherein the first layer is positioned adjacent to the layer containing the slowest emulsion of said dye-forming unit and between the layer containing the slowest emulsion and the second layer wherein in the layer containing the slowest emulsion of said dye-forming unit the slowest emulsion comprises tabular silver halide grains having a mean equivalent circular diameter of greater than 0.44 microns and less than 0.89 microns and wherein such grains account for at least 50% of the projected area of the grains in the emulsion layer when the layer contains a single emulsion and at least 25% of the projected area of the grains in the emulsion layer when the layer contains a blended emulsion.

2. The photographic element of claim 1 wherein the photographic element is a reversal element.

3. The photographic element of claim 1 wherein the second layer is a colloidal silver layer or a layer containing fogged grains.

4. The photographic element of claim 3 wherein the second layer is a colloidal silver layer.

5. The photographic element of claim 1 wherein the photographic element is a reversal element; wherein the second layer is a colloidal silver layer or a layer containing fogged grains; and wherein the first layer contains between 260 and 2200 mg gelatin/$m^2$ and is free from colloidal silver.

6. The photographic element of claim 1 wherein the first layer is free from colloidal silver.

7. The photographic element of claim 1 wherein the first layer comprises an oxidized developing agent scavenger.

8. The photographic element of claim 1 wherein in the layer containing the slowest emulsion of said dye-forming unit the slowest emulsion comprises tabular silver halide grains having a mean equivalent circular diameter of greater than 0.47 microns and less than 0.80 microns and wherein such grains account for at least 50% of the projected area of the grains in the emulsion layer when the layer contains a single emulsion and at least 25% of the projected area of the grains in the emulsion layer when the layer contains a blended emulsion.

9. The photographic element of claim 8 wherein in the layer containing the slowest emulsion of said dye-forming unit the slowest emulsion comprises tabular silver halide grains having a mean equivalent circular diameter of greater than 0.50 microns and less than 0.70 microns and wherein such grains account for at least 50% of the projected area of the grains in the emulsion layer when the layer contains a single emulsion and at least 25% of the projected area of the grains in the emulsion layer when the layer contains a blended emulsion.

10. A color reversal silver halide photographic element comprising a support having situated thereon in order from the support a red light-sensitive, cyan dye-forming unit comprising a photosensitive silver halide emulsion layer and an image dye-forming coupler; a green light-sensitive, magenta dye-forming unit comprising a photosensitive silver halide emulsion layer and an image dye-forming coupler; and a blue light-sensitive, yellow dye-forming unit comprising a photosensitive silver halide emulsion layer and an image dye-forming coupler; the photographic element further comprising a first layer and a second layer, the second layer being a layer which provides a site of development for solution physical development; wherein at least one of the dye-forming units comprises two or more emulsion layers spectrally sensitized to the same region of the visible spectrum, but exhibiting different photographic sensitivities and wherein the first layer is positioned adjacent to the layer containing the slowest emulsion of said dye-forming unit and between the layer containing the slowest emulsion and the second layer; wherein in the layer containing the slowest emulsion of said dye-forming unit the slowest emulsion comprises tabular silver halide grains having a mean equivalent circular diameter of greater than 0.44 microns and less than 0.89 microns and wherein such grains account for at least 50% of the projected area of the grains in the emulsion layer when the layer contains a single emulsion and at least 25% of the projected area of the grains in the emulsion layer when the layer contains a blended emulsion.

11. The photographic element of claim 10 wherein in the layer containing the slowest emulsion of said dye-forming unit the slowest emulsion comprises tabular silver halide grains having a mean equivalent circular diameter of greater than 0.47 microns and less than 0.80 microns.

12. The photographic element of claim 11 wherein in the layer containing the slowest emulsion of said dye-forming unit the slowest emulsion comprises tabular silver halide grains having a mean equivalent circular diameter of greater than 0.50 microns and less than 0.70 microns.

13. The photographic element of claim 10 wherein the second layer is a colloidal silver layer or a layer containing fogged grains.

14. The photographic element of claim 13 wherein the second layer is a colloidal silver layer.

15. The photographic element of claim 10 wherein the dye-forming unit comprising two or more emulsion layers is the blue light-sensitive, yellow dye-forming unit and the first and second layers are positioned between the blue light-sensitive, yellow dye-forming unit and the green light-sensitive, magenta dye-forming unit.

16. The photographic element of claim 10 wherein the tabular silver halide grains have a mean Tabularity of greater than about 10.

17. The photographic element of claim 16 wherein the tabular silver halide grains have a mean Tabularity of greater than about 25.

18. The photographic element of claim 10 wherein the halide content of the tabular grains is at least 90 mole percent bromoiodide.

19. The photographic element of claim 10 wherein the first layer is free from colloidal silver.

20. The photographic element of claim 10 wherein the first layer comprises an oxidized developing agent scavenger.

21. The photographic element of claim 10 wherein the first layer contains between 260 and 2200 mg of gelatin/$m^2$.

22. The photographic element of claim 10 wherein the second layer is a colloidal silver layer or a layer containing fogged grains; wherein the first layer contains between 260 and 2200 mg gelatin/$m^2$ and is free from colloidal silver; wherein the tabular silver halide grains have a mean Tabularity greater than 10 and wherein the halide content of the tabular grains is at least 90 mole percent bromoiodide.

23. A silver halide reversal color photographic element comprising a support having situated thereon in order from the support a red light-sensitive, cyan dye-forming unit comprising a photosensitive silver halide emulsion layer and a cyan image dye-forming coupler; a green light-sensitive, magenta dye-forming unit comprising a photosensitive silver halide emulsion layer and a magenta image dye-forming coupler; and a blue light-sensitive, yellow dye-forming unit comprising two or more emulsion layers spectrally sensitized to the same region of the visible spectrum, but exhibiting different photographic sensitivities, each such emulsion layer containing a yellow image dye-forming coupler; the photographic element further comprising between the blue light-sensitive, yellow dye-forming unit and the green light-sensitive, magenta dye-forming unit a first layer and a second layer, the second layer being a colloidal silver layer or a layer containing fogged grains; wherein the first layer is positioned adjacent to the layer containing the slowest emulsion of the blue light-sensitive, yellow dye-forming unit and between the layer containing the slowest emulsion and the second layer; wherein in the layer containing the slowest emulsion of the blue light-sensitive yellow dye-forming unit the slowest emulsion comprises tabular silver halide grains having a mean equivalent circular diameter of greater than 0.44 microns and less than 0.89 microns and a mean Tabularity of greater than about 25; wherein the halide content of the tabular grains is at least 90 mole percent bromoiodide; and wherein such grains account for at least 50% of the projected area of the grains in the emulsion layer when the layer contains a single emulsion and at least 25% of the projected area of the grains in the emulsion layer when the layer contains a blended emulsion.

24. The photographic element of claim 23 wherein in the layer containing the slowest emulsion of said dye-forming unit the slowest emulsion comprises tabular silver halide grains having a mean equivalent circular diameter of greater than 0.47 microns and less than 0.80 microns.

25. The photographic element of claim 23 wherein in the layer containing the slowest emulsion of said dye-forming unit the slowest emulsion comprises tabular silver halide grains having a mean equivalent circular diameter of greater than 0.50 microns and less than 0.70 microns.

26. The photographic element of claim 23 wherein the second layer is a colloidal silver layer.

27. The photographic element of claim 23 wherein the first layer contains between 260 and 2200 mg gelatin/$m^2$ and is free from colloidal silver.

* * * * *